US005124751A

United States Patent [19]

Fukui et al.

[11] Patent Number: 5,124,751

[45] Date of Patent: Jun. 23, 1992

[54] IMAGE FORMING APPARATUS WITH A TONER DENSITY CONTROL DEVICE

[75] Inventors: Kazuyuki Fukui, Toyohashi; Takanobu Yamada, Toyokawa, both of Japan

[73] Assignee: Minolta Camera Kabushiki Kaisha, Osaka, Japan

[21] Appl. No.: 698,811

[22] Filed: May 13, 1991

[30] Foreign Application Priority Data

May 15, 1990 [JP] Japan ..... 2-124600

[51] Int. Cl.[5] ..... G03G 21/00

[52] U.S. Cl. ..... 355/246; 118/653; 355/208

[58] Field of Search ..... 355/245, 246, 203, 204, 355/208, 251, 202; 371/16.4; 346/160; 118/653

[56] References Cited

U.S. PATENT DOCUMENTS

| | | | |
|---|---|---|---|
| 4,589,762 | 5/1986 | De Schamphelaere et al. . | |
| 4,592,645 | 6/1986 | Kanai et al. | 355/246 X |
| 4,785,331 | 11/1988 | Oka et al. | 355/208 |
| 4,888,618 | 12/1989 | Ishikawa | 355/208 |
| 4,963,927 | 10/1990 | Ishihara | 355/208 X |
| 4,969,011 | 11/1990 | Faull et al. | 355/208 |
| 4,980,727 | 12/1990 | Stelter | 355/246 |
| 4,989,039 | 1/1991 | Hayashi et al. | 355/208 |

FOREIGN PATENT DOCUMENTS

| | | | |
|---|---|---|---|
| 57-73771 | 5/1982 | Japan . | |
| 58-224363 | 12/1983 | Japan . | |
| 0014038 | 1/1987 | Japan | 355/246 |
| 0032477 | 2/1987 | Japan | 355/246 |

*Primary Examiner*—A. T. Grimley
*Assistant Examiner*—Sandra L. Brasé
*Attorney, Agent, or Firm*—Burns, Doane, Swecker & Mathis

[57] ABSTRACT

An image forming apparatus using a dual component developer. The apparatus comprises a first detection device for detecting a toner density of the developer; a second detection device for detecting an amount of a used toner; a determination device for determining an amount of the toner to be supplied in accordance with the toner density detected by the first detection means; and a revision device for revising the amount of the toner to be supplied determined by the determination means in accordance with the amount of used toner detected by the second detection means.

19 Claims, 9 Drawing Sheets

Light source
3
Light source driving section
28
D/A converter
27
Image data output section
25
Gamma compensating section
31
26
Level classifying section
32
Counter C1
Counter C2
Counter C3
Counter C4
33
D1
D2
D3
D4
Multiplier
34
Adder
35
Dot counter
Reset
Sum D
Accumulator
36
Reset
Pixel dot number
C P U
23
1st and 2nd operation number counter
15a
15b

IMAGE FORMING APPARATUS WITH A TONER DENSITY CONTROL DEVICE

BACKGROUND OF THE INVENTION (1) Field of the Invention

This invention relates to an image forming apparatus with a toner density control device, especially to the one for forming an image using the electrophotography system and a dual component developer.

(2) Description of the Related Art

A dual component developer comprises a toner for visualizing an electrostatic latent image on a photoconductive drum and a carrier for charging the toner by friction and carrying the toner to a developing area. While the carrier is kept in a certain amount in a developing device, the toner is consumed by the image forming.

A toner density, which would be reduced by the consumption of the toner and thus affect an image density, is maintained at a certain level by additional supply of the toner. The reduction in the toner density is detected magnetically or optically, and the toner is supplied based on the detection result.

In a detecting method using magnetism, the change in the amount of the carrier existing in a certain volume (including a space among toner and carrier grains) of the developer is detected in the form of the change in permeability.

A detecting method using optics is generally used for a color toner. The developer is illuminated by a light, and the toner density is detected in the form of the reflectance of the light.

The detected permeability or reflectance is converted into a voltage, which is compared with a reference voltage. The necessary amount of toner to be supplied is obtained based on the comparison result.

In the method using magnetism, the toner density is not directly detected but through the amount of the carrier. Accordingly, the detected toner density is influenced by elements other than the consumption of the toner, such as apparent density (weight/volume of the developer) or fluidity of the toner. In the method using optics also, the other elements influence the detected toner density as will be described below.

The followings are the main elements which influence the toner density detected by the above two methods.

1) A toner is usually added with approx. 0.2 to 1% of silica diffused therein as an after-treatment for improving fluidity and stabilizing chargeability. As the toner is stirred more and more, the silica is gradually separated from the toner. Accordingly, more use of the developer causes a reduction in the toner fluidity. As a result, the detected toner density tends to be higher than the actual one.

2) When consumed quickly, the toner is stirred for a short time, and so the silica is separated in a small amount. It means the difference between the detected density and the actual density depends on how quickly the toner is consumed.

3) In the case of the reversal development, in which a toner is adhered on a non-charged area of an electrostatic latent image, the toner is consumed from a portion thereof having a low chargeability. As more and more copies are made, highly chargeable portions of the toner are accumulated. Accordingly, the toner tends to cohere to the carrier. Such a phenomenon causes a change in the apparent density and a reduction in the toner fluidity. As a result, the detected density tends to be higher than the actual one.

4) Especially in the method using optics, there occurs the spent phenomenon of the carrier. In other words, as the developer is used more and more, the carrier is adhered with a broken toner and thus reflects the light although the carrier would normally absorb the light. This phenomenon also causes the detected toner density to be higher than the actual one.

As mentioned in 1) through 4), the detected density becomes higher and higher than the actual one as the developer is used more and more. Accordingly, the image density gets lower and lower.

Japanese Patent Laid-Open No. 57-73771 discloses revising the reference voltage with consideration that an accumulative number of operation times of the developing device (namely, an accumulative number of copies which have been made; will be referred to as the copy number) influences the apparent density. This disclosure has the following problems.

1) Since the toner consumption per copy is not always the same, a toner consumption which is assumed from the copy number is quite different from an actual one. This leads to an inappropriate revision of the reference voltage.

2) The disclosure does not consider that the apparent density is influenced by the environment of the developing device (for instance, humidity), which makes a difference between the detected toner density and the actual one.

SUMMARY OF THE INVENTION

Accordingly, this invention has an object of offering an image forming apparatus with a toner density control device for accurately controlling a toner density.

The above object is fulfilled by an image forming apparatus using a dual component developer having a first detection device for detecting a toner density of the developer, a second detection device for detecting a used amount of a toner, a determination device for determining an amount of the toner to be supplied in accordance with the toner density detected by the first detection device, and a revision device for revising the amount of the toner to be supplied determined by the determination device in accordance with the amount of used toner detected by the second detection device.

The second detection device may detect the used amount of the toner by measuring a number of pixel dots which form an image data.

According to the above construction, the toner density is controlled in consideration of a toner consumption based on, for example, an image data. Therefore, even if the detected toner density is influenced by the toner consumption, the toner density can be controlled accurately.

Practically, when the toner consumption is large, the toner is frequently supplied. The separation of silica as an after-treatment agent or other elements which influences the detected toner density are not conspicuous. Accordingly, it is judged the detected toner density is hardly different from the actual one. When the toner consumption is small, the toner is not frequently supplied, and so the above elements are influential on the detected toner density. Accordingly, it is judged that the detected toner density is quite different from the actual one.

In either case, in the above construction, the detected toner density is controlled appropriately in accordance with the difference between the detected density and the actual one.

The above object is also fulfilled by an image forming apparatus using a dual component developer having a toner density detection device for detecting a toner density, a first measuring device for measuring an accumulative time during which a developing device operates, a second measuring device for measuring an amount of a toner which is used in a predetermined time shorter than the accumulative time, and a toner supply device for supplying the toner in accordance with the toner density detected by the detection device, the accumulative time measured by the first measuring device and the used amount of the toner measured by the second measuring device.

The above object is also fulfilled by a toner density control device for a dual component developer having a toner density detection device for detecting a toner density, a comparing device for comparing the toner density detected by the detection device with a reference value so as to control the toner density in accordance with the comparison result, a first measuring device for measuring an accumulative time during which a developing device operates, a second measuring device for measuring an amount of a toner which is used in a predetermined time, and a revision device for revising a relationship between the detected toner density and the reference value, which are to be compared by the comparing device, in accordance with the accumulative time measured by the first measuring device and the amount of the used toner measured by the second measuring device.

According to the above construction, the toner density is controlled in consideration of the toner consumption per copy and the operation time of the developing device. Even if the detected toner density is influenced by these elements, an appropriate control thereof can be carried out.

The revision of the relationship between the reference value and the detected density may be done by revising the reference value, the detected toner density or the comparison result of the two.

The above object is also fulfilled by an image forming apparatus using a dual component developer having a first detection device for detecting a toner density, a second detection device for detecting a change of environment around a developing device, a first measuring device for measuring an accumulative time during which the developing device operates, a second measuring device for measuring an amount of a toner which is used in a predetermined time, a comparing device for comparing the toner density detected by the first detection device with a reference value, the comparing device including a revision device for revising the comparison result in accordance with the accumulative time measured by the first measuring device, the amount of the used toner measured by the second measuring device and the change of environment detected by the second detection device, and a toner supply device for supplying the toner in an amount calculated based on the comparison result revised by the revision device.

According to the above construction, the toner density is controlled in consideration of the environmental conditions of the developing device. As a result, the toner density is appropriately controlled under various conditions.

BRIEF DESCRIPTION OF THE INVENTION

These and other objects, advantages and features of the invention will become apparent from the following description thereof taken in conjunction with the accompanying drawings which illustrate a specific embodiment of the invention. In the drawings.

DESCRIPTION OF A PREFERRED EMBODIMENT

An embodiment of this invention will be described referring to FIGS. 1 through 11.

Figure 1:
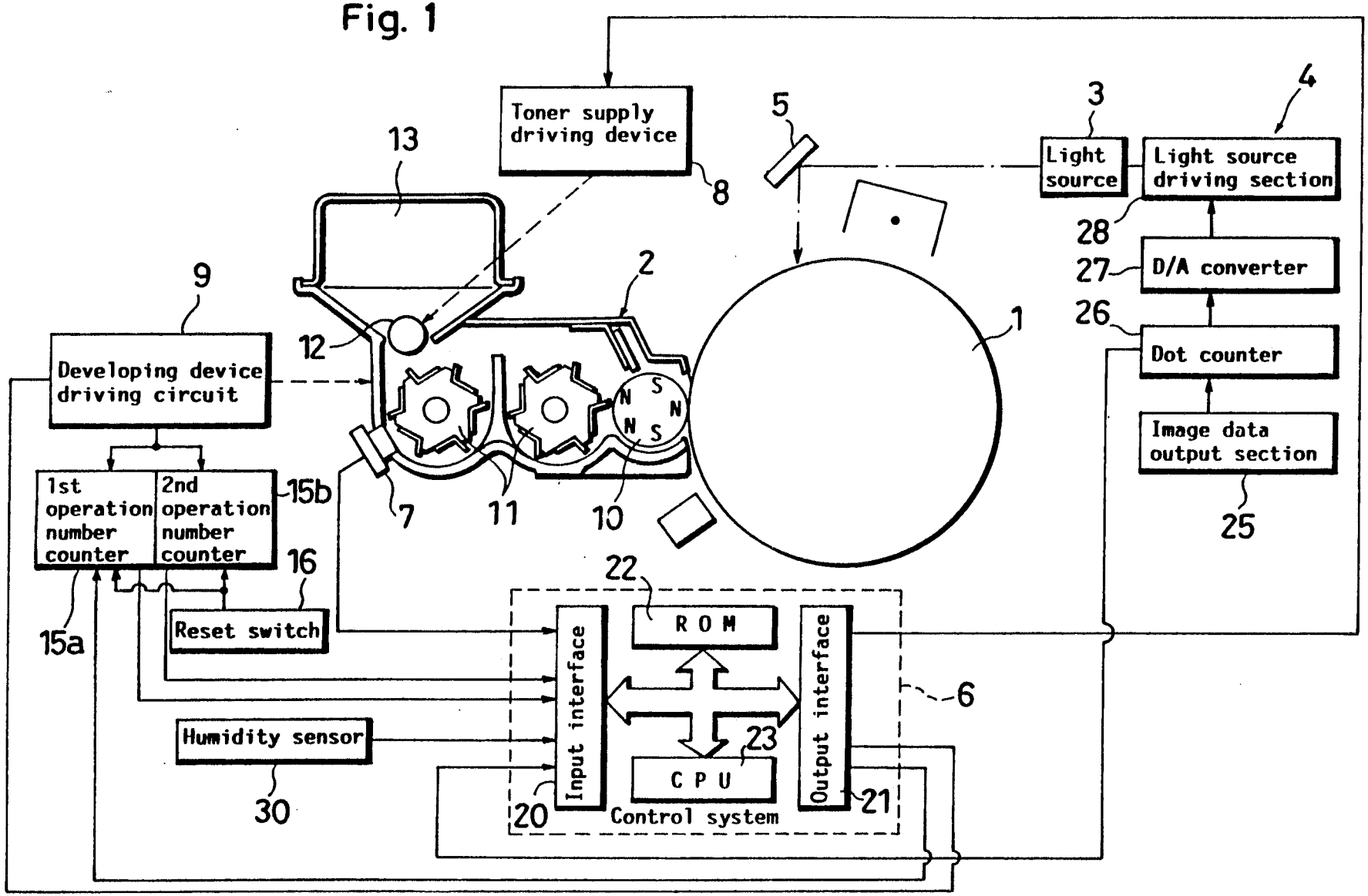
FIG. 1 is a view showing the positional relationship and connections of comprising elements of a copier as an embodiment according to this invention.

A digital color copier comprises a photoconductive drum 1, a developing device 2, a light source 3 for exposure, a light source driving system 4, a mirror 5, a control system 6, a toner density sensor 7 of the photoelectric type, a toner supply driving device 8, and a developing device driving circuit 9, all of which are provided and connected as shown in FIG. 1.

Although the digital color copier is equipped with a plurality of developing devices, only one of them is shown in FIG. 1 for easier explanation.

The developing device 2 comprises a magnet roller 10 for carrying a dual component developer to a position opposed to a peripheral surface of the drum 1 and thus supplying a color toner to the drum 1, stirring units 11 for stirring the developer, a toner supplying roller 12 and a toner hopper 13 for storing the toner.

The developing device driving circuit 9 for driving the developing device 2 is connected with first and second operation number counters 15*a* and 15*b* each for counting an accumulative number of operation times of the developing device 2 (namely, the copy number).

The counted copy number is sent to a CPU 23 through an input interface 20. The first and the second counters 15*a* and 15*b* are reset by a reset switch 16 each time the developing device 2 is renewed. The first counter 15*a* is also reset by the CPU 23 each time the counter 15*a* counts a specified value (2,000 in this embodiment).

The control system 6 comprises the input interface 20, an output interface 21, a ROM 22 and the CPU 23. The CPU 23 is a core of the toner density control as well as executing the total control of the copier. The ROM 22 stores tables which are used for the toner density control.

A humidity sensor 30 is for detecting a relative humidity in the vicinity of the developing device 2. The detection result is sent to the CPU 23 through the input interface 20.

Figure 2:
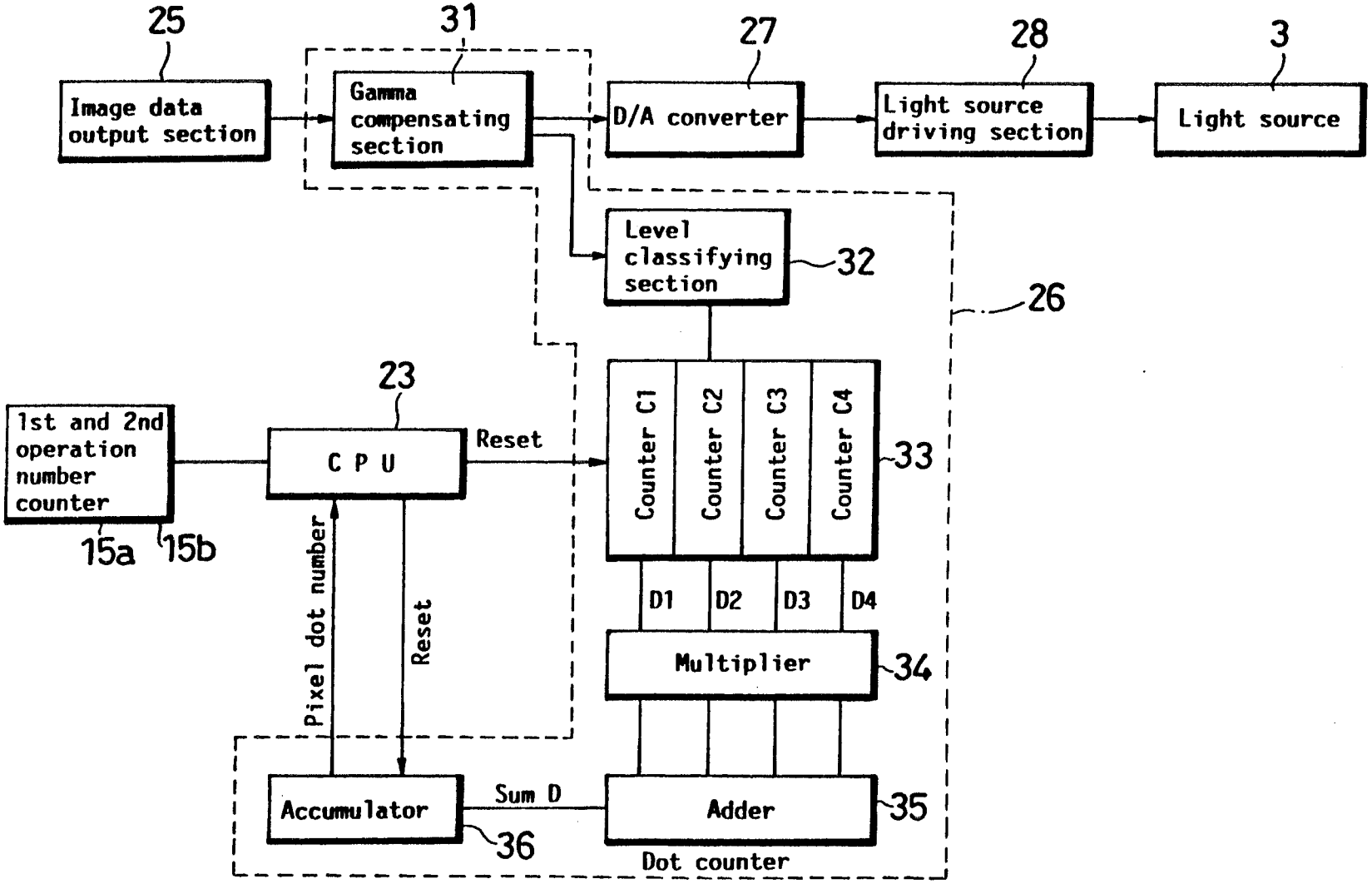
FIG. 2 is a block diagram of a dot counter and peripheral elements thereof.

As shown in FIG. 2, the light source driving system 4 comprises an image data output section 25, a dot counter 26, a D/A converter 27 and a light source driving section 28. The image data output section 25 is for A/D-converting an output from a CCD sensor (not shown) and compensating the diversion of CCD sensitivities and the like. The dot counter 26 comprises a gamma compensating section 31, a level classifying section 32, a counter group 33, a multiplier 34, an adder 35 and an accumulator 36.

The gamma compensating section 31 is for compensating an 8-bit image data from the section 25 and outputting a 10-bit data, which is conformable to the sensitivity of the drum 1.

The level classifying section 32 is for classifying each pixel dot of a 10-bit data sent from the gamma compensating section 31 into four gradation levels. A pixel dot having a gradient between 0 and 255 (upper two bits: 00) is classified as Level 1, between 256 and 511 (upper two bits: 01) as Level 2, between 512 and 767 (upper two bits: 10) as Level 3, and between 768 and 1,023 (upper two bits: 11) as Level 4.

Counters C1 through C4 of the counter group 33 are for counting the number of pixel dots which are classified as Levels 1 through 4, respectively, per copy. The counters C1 through C4 are reset by the CPU 23 per copy.

The multiplier 34 is for multiplying a counting result D1 of the counter C1 by 1, a counting result D2 of the counter C2 by 2, a counting result D3 of the counter C3 by 3, and a counting result D4 of the counter C4 by 4.

The adder 35 is for adding the outputs from the multiplier 34 to obtain a sum D. The sum D, which is expressed by Formula 1, indicates the number of pixel dots of each copy, the number being calculated in terms of pixel dots each having a gradient between 0 through 255. For example, a pixel dot having a gradient between 768 and 1,023 is regarded as 4 pixel dots.

$$D = D1 \times 1 + D2 \times 2 + D3 \times 3 + D4 \times 4 \qquad \text{Formula 1}$$

The accumulator 36 is for accumulating the sums D with the progress of the copying operation, whereby to obtain an accumulative number of pixel dots (will be referred to as the pixel dot number) ND.

The obtained pixel dot number ND is read by the CPU 23. When the first counter 15*a* counts 2,000, the CPU 23 divides the pixel dot number ND at that point by 2,000, whereby obtaining an average pixel dot number per copy. Since an average pixel dot number corresponds to a ratio of a size of a toner-adhered area with respect to a size of an image forming area, the above average pixel dot number will be referred to as average B/W, hereinafter. The CPU resets the accumulator 36 after obtaining the average B/W.

Figure 3:
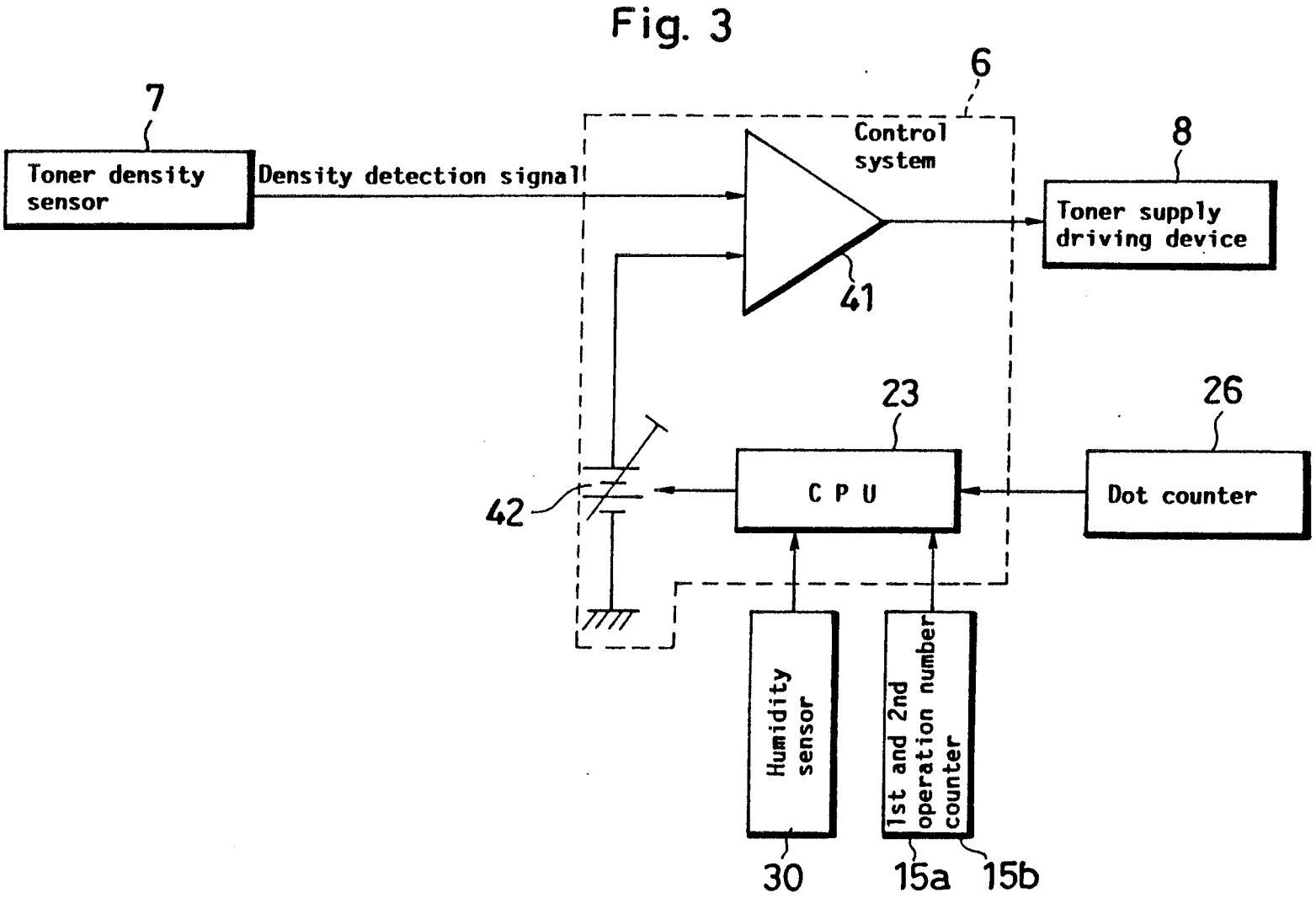
FIG. 3 is a block diagram of an essential part of a control system.

As shown in FIG. 3, the control system 6 further comprises a comparator 41 for comparing a density detection signal sent from the toner density sensor 7 and a reference voltage sent from a reference voltage generator 42. The density detection signal indicates a density detection voltage. The reference voltage generator 42 is for revising the reference voltage in accordance with a revising amount obtained by the CPU 23.

The CPU 23 obtains the revising amount of the reference voltage based on counting results sent from the counters 15*a* and 15*b*, the average B/W and if necessary the value of the relative humidity sent from the sensor 30.

The principle of revising the reference voltage will be explained below.

Figure 4:
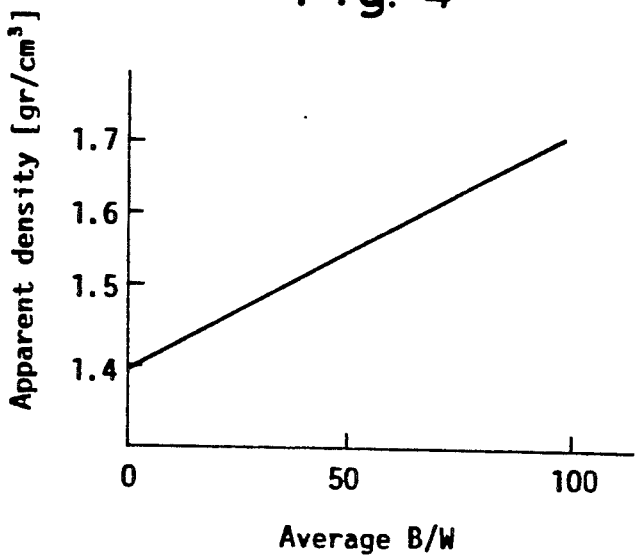
FIG. 4 is a graph showing the relationship between the average B/W and the apparent density.
Figure 5:
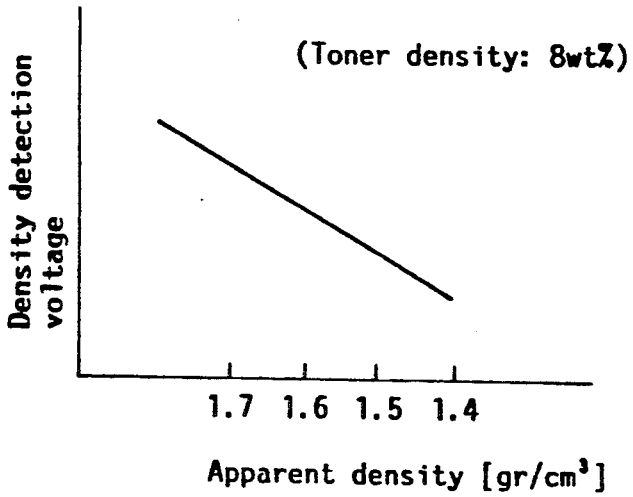
FIG. 5 is a graph showing the relationship between the apparent density and the density detection voltage.

FIG. 4 shows the relationship between the average B/W of the last 2,000 copies and the apparent density. FIG. 5 shows the relationship between the apparent density and the density detection voltage obtained from the sensor 7 when the toner density is 8 wt %.

The reference voltage to realize the toner density of 8 wt % is obtained by 1) obtaining the apparent density from the average B/W based on FIG. 4, and then 2) obtaining the density detection voltage, which would be obtained from the sensor 7 when the toner density is 8 wt %, from the apparent density based on FIG. 5. The obtained voltage is the reference voltage.

If the relationship between the average B/W and the density detection voltage at a desirable toner density is known in advance as above, an appropriate reference voltage can be obtained in accordance with any average B/W.

Although the density detection voltage is obtained through the apparent density in the above method, the voltage may be obtained directly from the average B/W.

When the density detection voltage is more influenced by the average B/W than by the copy number, the above method brings about a reference voltage with enough accuracy. If such a condition is not realized due to the construction of the copier or the type of the developer, the desirable reference voltage is obtained in the following way.

Figure 6:
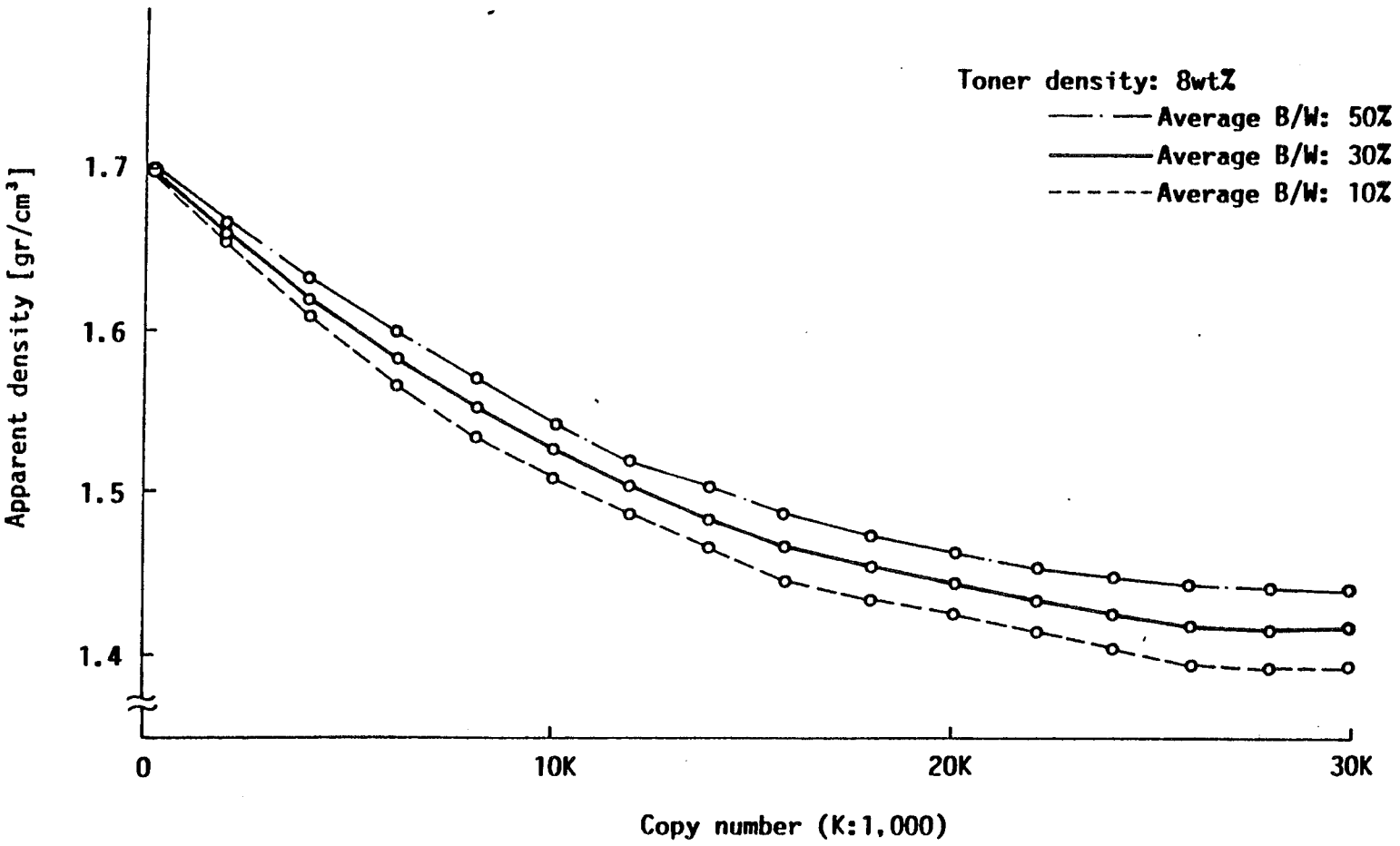
FIG. 6 is graph showing the relationship between the copy number and the apparent density.

FIG. 6 shows the relationship between the copy number (the counting result of the second counter 15*b*) and the apparent density. The relationship was obtained when the average B/W is 50%, 30% and 10%. When the average B/W is high, the apparent density is reduced slowly as the copy number is increased. When the average B/W is low, the reduction in the apparent density is drastic.

Figure 7:
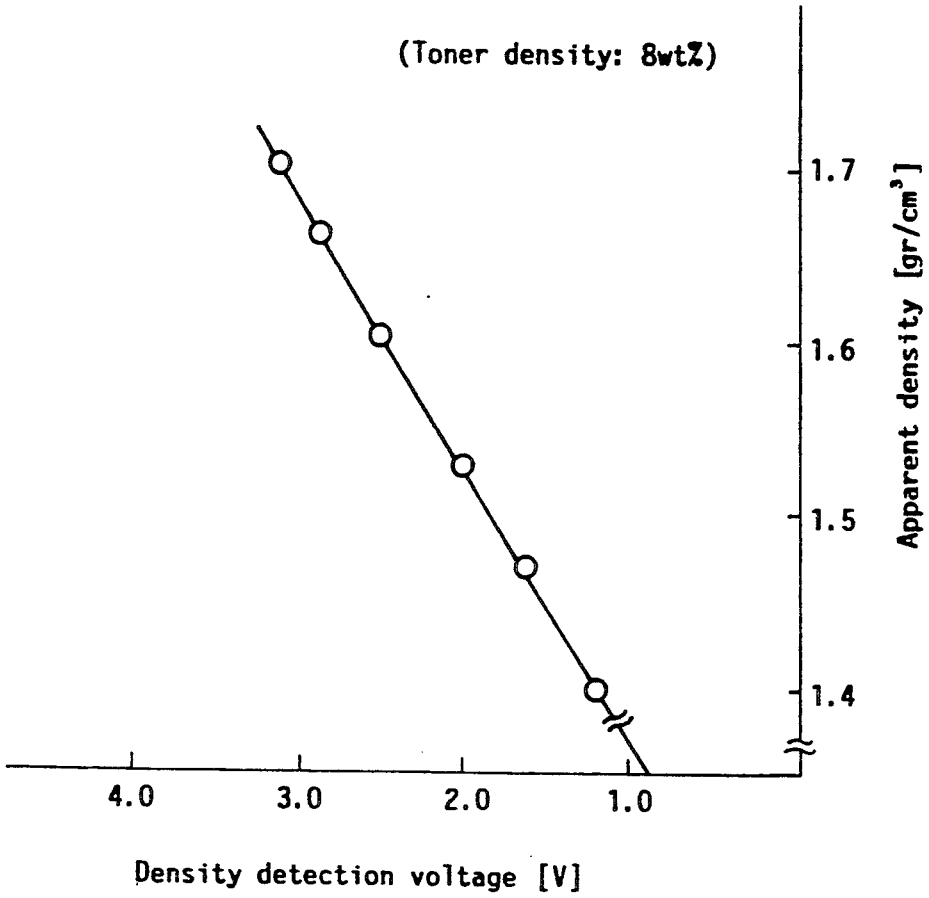
FIG. 7 is graph showing the relationship between the density detection voltage and the apparent density.

FIG. 7 shows the relationship between the density detection voltage and the apparent density. The relationship is obtained when the toner density is 8 wt %. The density detection voltage is decreased as the apparent density is lowered at the rate of 0.63V per $0.1 g/cm^3$. The apparent density is assumed from the average B/W and the copy number. Accordingly, the density detection voltage is obtained from the apparent density based on FIG. 7. The obtained voltage is the desirable reference voltage.

The following is a more detailed explanation on how to obtain the reference voltage.

The average B/W is classified as high (average B/W > 40), medium (20 ≦ average B/W < 40) or low (average B/W ≦ 20). Table 1 stored in the ROM 22 as a look-up table shows the apparent density, the reference voltage $V_N$ and the revising amount $\Delta V_N$ in association with the copy numbers. The reference voltage $V_N$ is a representative voltage which would be outputted from the sensor 7 when the toner density is 8 wt % and the average B/W is classified as medium. The revising amount $\Delta V_N$ is a difference between the above voltage and a voltage which is outputted when the average B/W is classified as high, medium and low.

The sum of $V_N$ and $\Delta V_N$ is the desirable reference voltage V (Formula 2).

$$V = V_N + \Delta V_N \qquad \text{Formula 2}$$

When the average B/W is medium, $V = V_N$. When the average B/W is high and low, $V = V_N + \Delta V_N$.

TABLE 1

| Copy number | Apparent density | Reference voltage $V_N$ (B/W: medium) | Revising amount $\Delta V_N$ High | Medium | Low |
|---|---|---|---|---|---|
| 0-2,000 | 1.660 | 2.847 | 0.032 | 0 | −0.032 |
| 2,001-4,000 | 1.620 | 2.594 | 0.048 | 0 | −0.048 |
| 4.001-6,000 | 1.575 | 2.309 | 0.064 | 0 | −0.064 |
| 6.001-8,000 | 1.550 | 2.151 | 0.080 | 0 | −0.080 |
| 8,001-10,000 | 1.528 | 2.011 | 0.095 | 0 | −0.095 |
| 10,001-12,000 | 1.518 | 1.948 | 0.101 | 0 | −0.101 |
| 12,001-14,000 | 1.488 | 1.758 | 0.107 | 0 | −0.107 |
| 14,001-16,000 | 1.468 | 1.631 | 0.114 | 0 | −0.114 |
| 16,001-18,000 | 1.460 | 1.581 | 0.120 | 0 | −0.120 |
| 18,001-20,000 | 1.450 | 1.517 | 0.127 | 0 | −0.127 |
| 20,001-22,000 | 1.440 | 1.454 | 0.133 | 0 | −0.133 |
| 22,001-24,000 | 1.430 | 1.391 | 0.139 | 0 | −0.139 |
| 24,001-26,000 | 1.425 | 1.359 | 0.146 | 0 | −0.146 |
| 26,001-28,000 | 1.425 | 1.359 | 0.152 | 0 | −0.152 |
| 28,001-30,000 | 1.425 | 1.359 | 0.158 | 0 | −0.158 |

*Desirable toner density: 8 wt %

If the relative humidity should be considered to revise the reference voltage, the revision is carried out as below.

Figure 8:
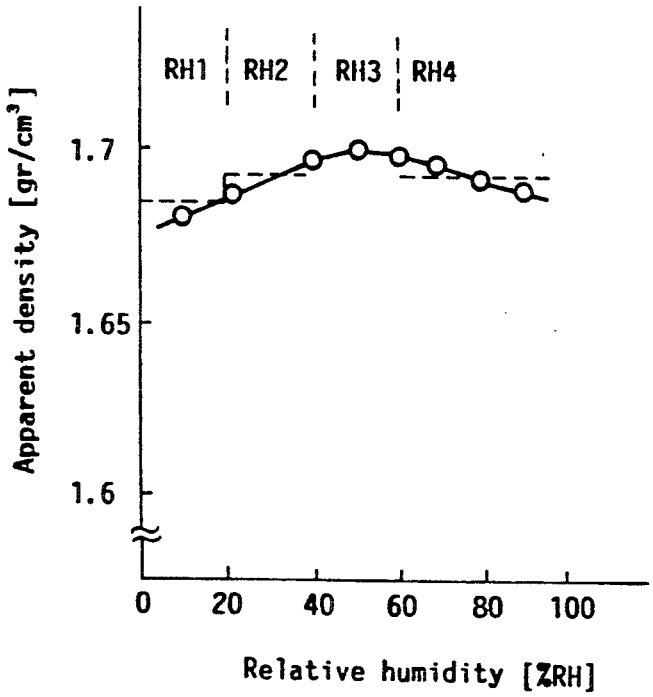
FIG. 8 is graph showing the relationship between the relative humidity and the apparent density.

FIG. 8 shows the relationship between the relative humidity in the vicinity of the developing device 2 and the apparent density. The relative humidity RH detected by the humidity sensor 30 is divided into a first range ($0 \leqq RH < 20\%$), a second range ($20 \leqq RH < 40\%$), a third range ($40 \leqq RH < 60\%$) and a fourth range ($60 \leqq RH < 80\%$). When the detected humidity RH is classified into the first range, the revising amount $V_{RH}$ is set at −0.030V. For the other ranges, the revising amounts are set as shown in Table 2.

TABLE 2

| Range | 1 | 2 | 3 | 4 |
|---|---|---|---|---|
| Revising amount $V_{RH}$ | −0.030 V | −0.015 V | ±0 | −0.015 V |

When the humidity should be considered to revise the reference voltage, the reference voltage V is obtained by Formula 3.

$$V = V_N + \Delta V_N + V_{RH} \qquad \text{Formula 3}$$

How the toner density is practically controlled will be explained hereinafter.

Figure 9:
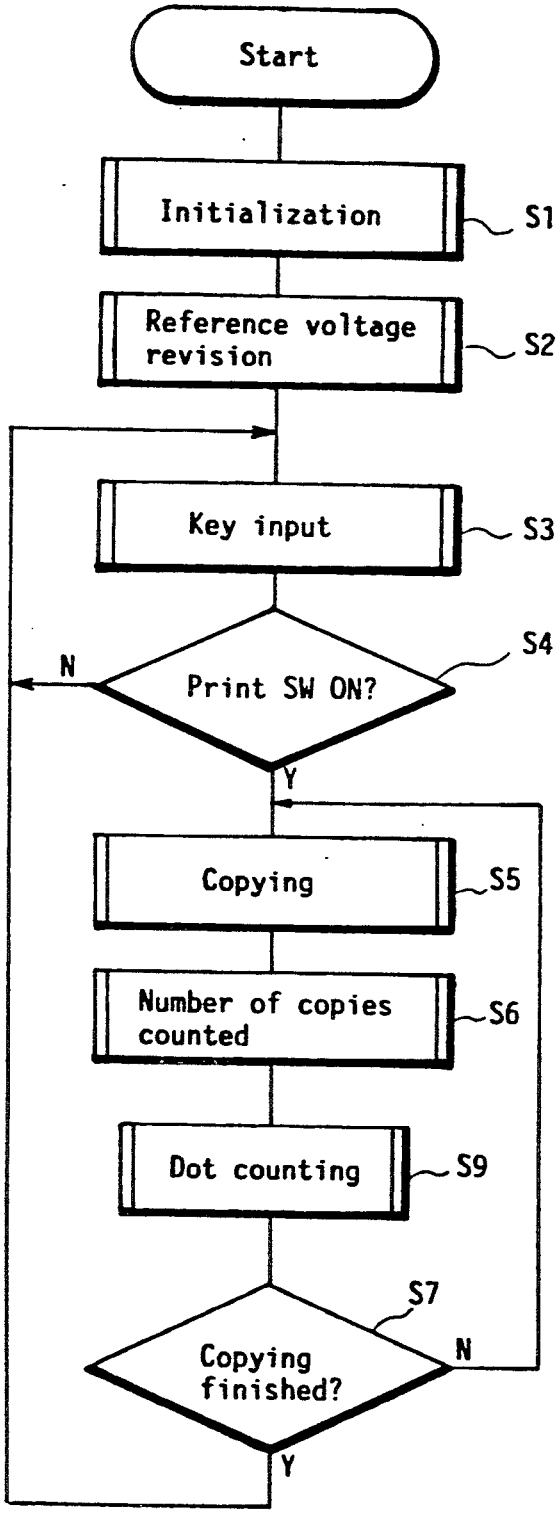
FIG. 9 is a flowchart of a main routine of the copier.

A main routine of the CPU 23 is shown in FIG. 9.

When the copier is turned on, initialization is done (S1), and then a reference voltage revision is done (S2) for toner density control. The toner density control is executed based on the result of the dot counting in S9. A specified reference voltage is set for the first while (up to the copy number of 2,000) after a developing device 2 is set. In S3, various conditions including how many copies is to be made are inputted through keys. Whether a print switch has been turned on or not is judged (S4). If not, the operation goes back to S3; and if the print key has been turned on, copying is done (S5), the copy number is counted (S6), and the dot counting is done (S9) to obtain the average B/W. Whether the inputted number of copies have been finished or not is judged (S7). If so, the operation goes back to S3; and if not, the operation goes back to S5 to continue copying.

Figure 10:
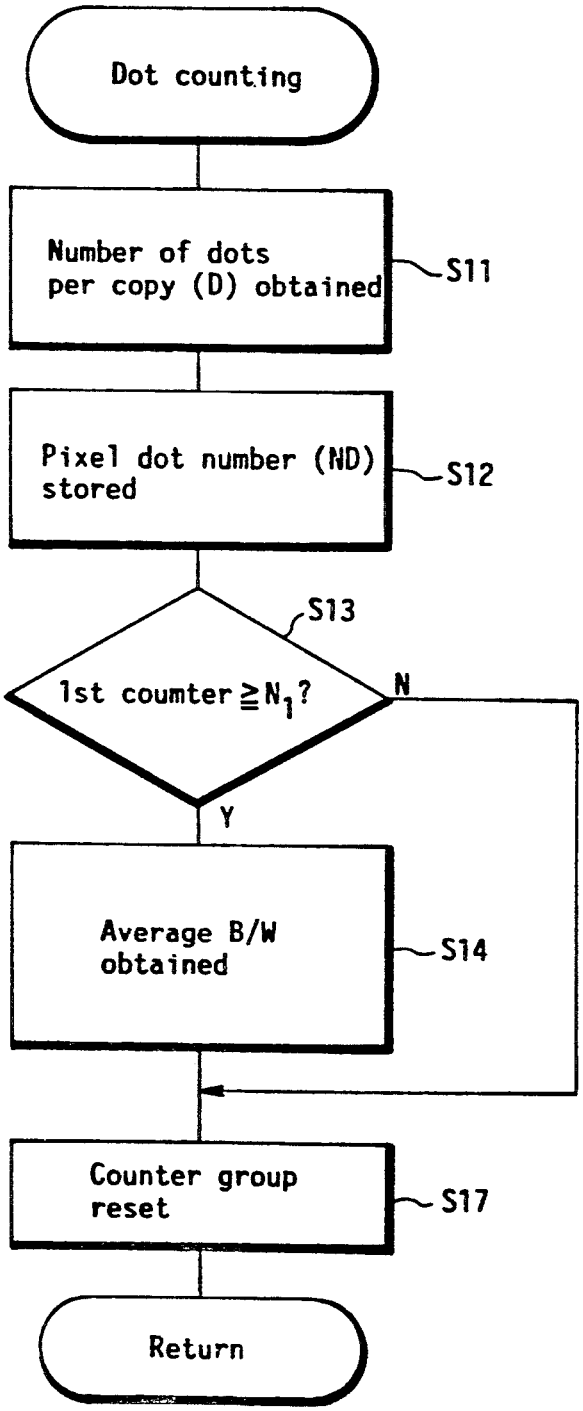
FIG. 10 is a flowchart of a subroutine of dot counting.

FIG. 10 shows a subroutine of the dot counting. Every time a copy is made (namely, every time the developing device 2 is operated), a pixel dot number D is obtained (S11), and the pixel dot numbers D are accumulated one after another to obtain an accumulative pixel dot number ND for storage (S12). Whether the copy number counted by the first counter 15*a* has reached a specified value $N_1$ (2,000 for instance) or not is judged (S13). If not, the operation goes to S17, where the counter group 33 is reset, and returns to the main routine. If the accumulative copy number has reached the specified value $N_1$, the pixel dot number ND is divided by 2,000 to obtain the average B/W and then the operation goes to S17.

Figure 11:
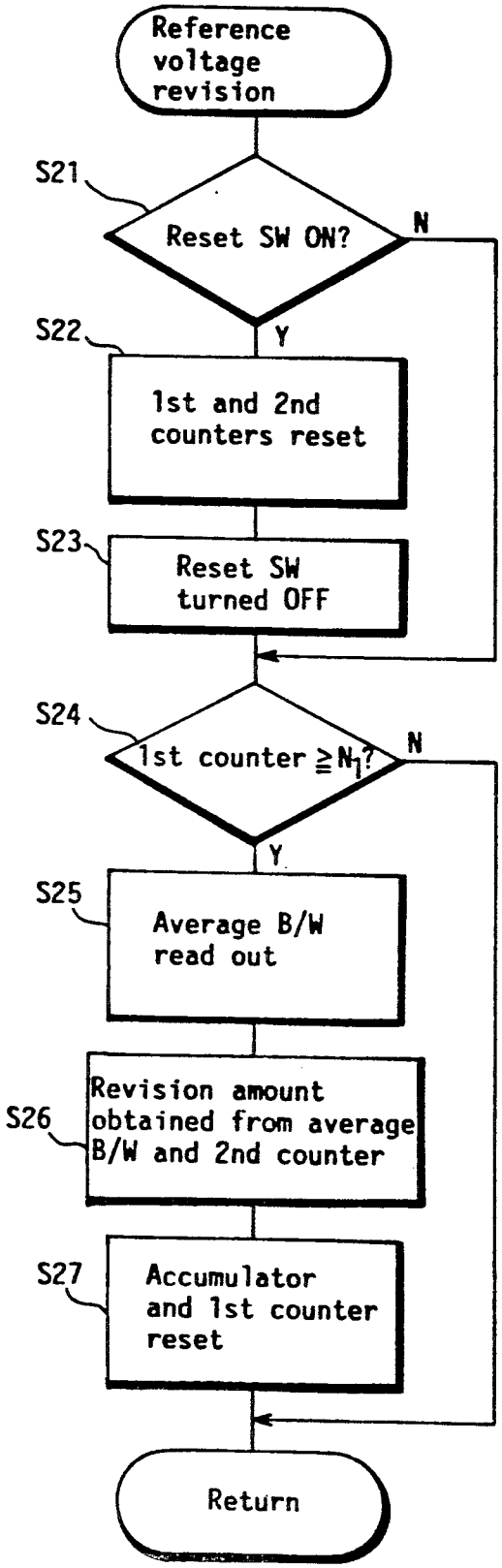
FIG. 11 is a flowchart of a subroutine of reference value revision.

FIG. 11 shows a subroutine of the reference voltage revision based on the copy number and the average B/W. Whether the reset switch 16 has been turned on or not is judged (S21). If not, the operation goes to S24. If the reset switch 16 has been turned on, the first and the second counters 15*a* and 15*b* are reset (S22), the reset switch 16 is turned off (S23) and the operation goes to S24. In S24, whether the value counted by the first counter 15*a* has reached the specified value $N_1$ or not is judged. If not, the operation returns to the main routine. If the value has reached $N_1$, the average B/W is read out (S25). Then, a revising amount of the reference voltage is obtained from the B/W and the accumulative copy number in accordance with Formula 2 or 3 (S26), thereafter the accumulator 36 and the counter 15*a* are reset (S27). Then, the operation returns to the main routine.

Since a change in the toner density greatly influences the colors in multi-color copying, accurate toner density control is important. Thus, a toner density control device according to this invention is especially useful in multi-color copying.

In multi-color copying, the procedure including pixel dot number counting, toner consumption measurement and revision is carried out for each color.

Needless to say, this invention is applicable to a black toner as well as a color toner, and also to a printer and a facsimile machine as well as a copier.

Although the reference voltage is revised based on the copy number and the average B/W (and if necessary, the relative humidity) in this embodiment, the revision may be done based only on the average B/W if the copier and the developer are of an appropriate construction and type.

In the above embodiment, the average B/W of only the last 2,000 copies is used. The average B/W of the last 2,000 copies and an average B/W of the 2,000 copies preceding the above last 2,000 copies may be used in combination. Or an average B/W of all the copies made after the developer is renewed may be used.

The toner density sensor may be of the magnetic-type or of the optical type.

Instead of the reference voltage, the density detection signal or the comparison result obtained by the comparator 31 may be revised.

Although the number of operation times of the developing device 2 is counted in the above embodiment, the number of ON signals sent from the developing device 2 or the time period during which the developing device 2 is operated may be counted.

Although the present invention has been fully described by way of an embodiment with references to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus using a dual component developer, comprising:
first detection means for detecting a toner density of a developer;
second detection means for detecting an amount of a used toner;
determination means for determining an amount of the toner to be supplied in accordance with the toner density detected by said first detection means; and
revision means for revising the amount of the toner to be supplied determined by said determination means in accordance with the amount of used toner detected by said second detection means.

2. An image forming apparatus as claimed in claim 1, wherein said second detection means detects the amount of the used toner by measuring a number of pixel dots which form an image data.

3. A toner density control device for a dual component developer, comprising:
toner density detection means for detecting a toner density;
comparing means for comparing the toner density detected by said detection means with a reference value so as to control the toner density in accordance with the comparison result;
first measuring means for measuring an accumulative time during which a developing device operates;
second measuring means for measuring an amount of a toner used in a predetermined time; and
revision means for revising a relationship between the detected toner density and the reference value, which are to be compared by said comparing means, in accordance with the accumulative time measured by said first measuring means and the amount of the used toner measured by said second measuring means.

4. An image forming apparatus as claimed in claim 3, further comprising toner supply means for supplying the toner according to an amount calculated by the comparison result.

5. An image forming apparatus as claimed in claim 3, wherein said revision means revises the reference value in accordance with the accumulative time measured by said first measuring means and the amount of the used toner measured by said second measuring means.

6. An image forming apparatus as claimed in claim 3, wherein said first measuring means includes a first counter which counts an accumulative number of operations of the developing device and is reset when the developing device is renewed.

7. An image forming apparatus as claimed in claim 3, wherein said second measuring means includes a second counter which counts a number of operations of the developing device and is reset each time a predetermined number is counted.

8. An image forming apparatus as claimed in claim 3, wherein said toner density detection means detects the toner density by use of magnetism.

9. An image forming apparatus as claimed in claim 3, wherein said toner density detection means detects the toner density by use of reflectance of a light emitted to a developer.

10. An image forming apparatus using a dual component developer, comprising:
first detection means for detecting a toner density;
second detection means for detecting a change of environment around a developing device;
first measuring means for measuring an accumulative time during which the developing device operates;
second measuring means for measuring an amount of a toner used in a predetermined time;
comparing means for comparing the toner density detected by said first detection means with a reference value, said comparing means including revision means for revising a relationship between the toner density and the reference value in accordance with the accumulative time measured by said first measuring means, the amount of the used toner measured by said second measuring means and the change of environment detected by said second detection means; and
toner supply means for supplying the toner according to the comparison result based on the relationship revised by said revision means.

11. An image forming apparatus as claimed in claim 10, wherein said revision means revises the reference value in accordance with the amount of the used toner, the accumulative time and the change of environment.

12. An image forming apparatus as claimed in claim 10, wherein said second detection means detects a change of humidity.

13. An image forming apparatus as claimed in claim 10, wherein said second measuring means measures an average amount of the used toner per copy.

14. An image forming apparatus as claimed in claim 10, wherein said second measuring means measures the amount of the used toner by counting a number of pixel dots which form an image data.

15. An image forming apparatus as claimed in claim 10, wherein said first measuring means includes a first counter which counts as accumulative number of operations of the developing device and is reset when the developing device is renewed.

16. An image forming apparatus as claimed in claim 10, wherein said second measuring means includes a second counter which counts a number of operations of the developing device and is reset every time a predetermined number is counted.

17. An image forming apparatus as claimed in claim 10, wherein said toner density detection means detects the toner density by use of magnetism.

18. An image forming apparatus as claimed in claim 10, wherein said toner density detection means detects the toner density by use of reflectance of a light emitted to a developer.

19. An image forming apparatus using a dual component developer, comprising:
a digital image data generating portion for generating an image data with pixel dots each of which has a gradation;
a developing portion for visualizing an electrostatic latent image formed in accordance with the image data generated by said digital image data generating portion;
a count portion for counting a number of the pixel dots which form the image data and for outputting a toner data indicative of a consumption amount of a toner, said count portion including modification means for modifying the counting result in accordance with a degree of the gradation of each pixel dot to output the toner data; and
a supply portion for supplying the toner in accordance with the toner data.

* * * * *